US006883468B2

(12) United States Patent
Lehman

(10) Patent No.: US 6,883,468 B2
(45) Date of Patent: Apr. 26, 2005

(54) PREMIXED FUEL AND GAS METHOD AND APPARATUS FOR A COMPRESSION IGNITION ENGINE

(75) Inventor: David L Lehman, Metamora, IL (US)

(73) Assignee: Caterpillar Inc, Peoria, IL (US)

( * ) Notice: Subject to any disclaimer, the term of this patent is extended or adjusted under 35 U.S.C. 154(b) by 18 days.

(21) Appl. No.: 10/400,302

(22) Filed: Mar. 27, 2003

(65) Prior Publication Data

US 2004/0187804 A1 Sep. 30, 2004

(51) Int. Cl.[7] ..... F02B 3/00
(52) U.S. Cl. ..... 123/27 R; 123/288
(58) Field of Search ..... 123/27 R, 288

(56) References Cited

U.S. PATENT DOCUMENTS

| | | | | |
|---|---|---|---|---|
| 2,021,744 A | * | 11/1935 | Perkins | 123/288 |
| 2,122,785 A | * | 7/1938 | Tinker et al. | 123/27 R |
| 2,914,047 A | | 11/1959 | Colton | |
| 3,127,878 A | * | 4/1964 | Levnig et al. | 123/288 |
| 4,651,525 A | | 3/1987 | Cestero | |
| 4,860,699 A | | 8/1989 | Rocklein | |
| 5,024,184 A | | 6/1991 | Nagano et al. | |
| 5,054,457 A | | 10/1991 | Sakamoto | |
| 5,094,217 A | | 3/1992 | Kaku et al. | |
| 5,201,907 A | | 4/1993 | Hitomi et al. | |
| 5,207,204 A | | 5/1993 | Kawachi et al. | |
| 5,211,682 A | | 5/1993 | Kadowaki et al. | |
| 5,476,072 A | | 12/1995 | Guy | |
| 5,699,758 A | | 12/1997 | Clarke | |
| 5,970,944 A | | 10/1999 | Kawamura | |
| 6,371,093 B1 | | 4/2002 | Kaku et al. | |

* cited by examiner

*Primary Examiner*—Noah P. Kamen
(74) *Attorney, Agent, or Firm*—Finnegan, Henderson, Farabow, Garrett & Dunner

(57) ABSTRACT

A method and apparatus for delivering a mixture of fuel and gas to a combustion chamber of a compression ignition engine. The method and apparatus includes compressing a gas to a pressure sufficient to initiate combustion of a fuel, delivering a stream of the gas toward the combustion chamber, injecting a quantity of fuel into the stream of gas to create a near homogeneous fuel and gas mixture, and delivering the fuel and gas mixture to the combustion chamber such that combustion occurs substantially within the combustion chamber.

23 Claims, 11 Drawing Sheets

Fig. 3a.
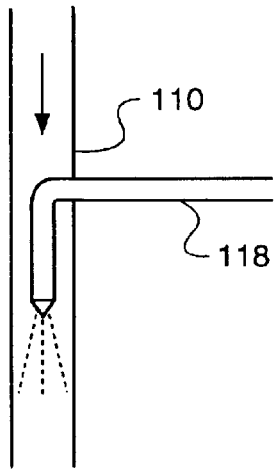
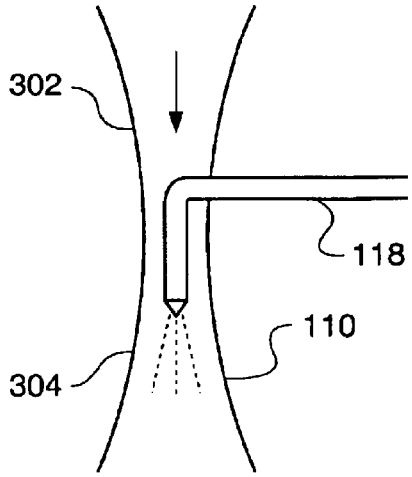
Fig. 3b.
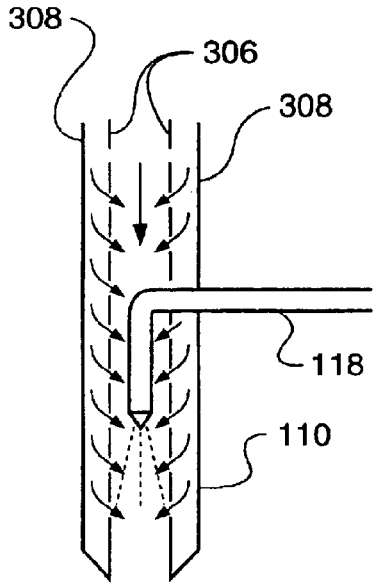
Fig. 3c.

Fig. 6a.
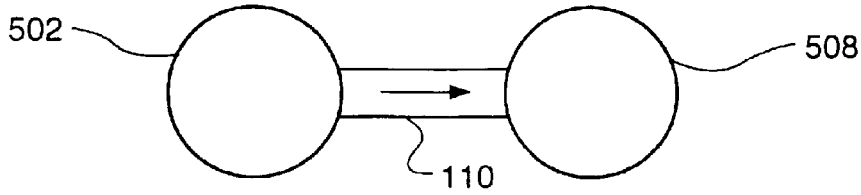
Fig. 6b.
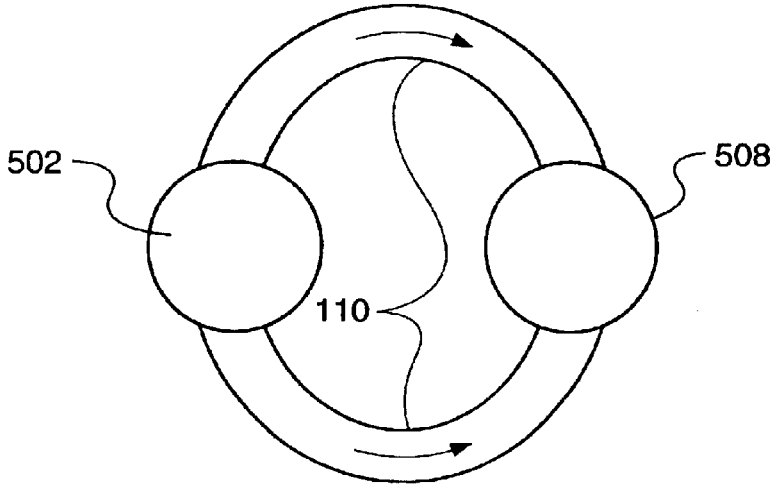
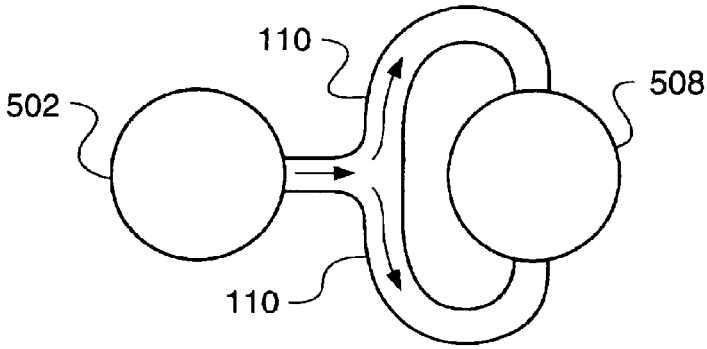
Fig. 6c.

PREMIXED FUEL AND GAS METHOD AND APPARATUS FOR A COMPRESSION IGNITION ENGINE

TECHNICAL FIELD

This invention relates generally to a method and apparatus for injecting fuel and gas into a combustion chamber of a compression ignition engine and, more particularly, to a method and apparatus for premixing fuel and gas during injection into the combustion chamber.

BACKGROUND

Compression ignition engines, for example diesel engines, operate by combustion of fuel and gas mixtures caused by compression of the mixtures, usually within a combustion chamber during a compression stroke. Compression engines offer the advantage of high output power for the amount of fuel used.

The combustion process, however, results in some amounts of emission by-products, such as NOx, HC, soot, and the like, being generated. The amount of emissions may be increased under certain conditions. For example, incomplete mixing of the fuel and gas results in higher temperature regions within the combustion envelope, thus resulting in increased levels of NOx. Higher temperatures overall within the combustion chamber also cause increased amounts of NOx.

Attempts to control various engine parameters and thus reduce emissions have met with limited success. One such strategy which shows promise is the use of homogeneous charge compression ignition (HCCI) technology. HCCI attempts to thoroughly mix the fuel and air within the combustion chamber to provide for uniform combustion temperatures. However, it has proven to be extremely difficult to achieve true HCCI operations and maintain control over the combustion process.

In U.S. Pat. No. 4,860,699, Rocklein discloses a two-cycle engine which delivers a mixture of fuel and air to the combustion chamber through a baffle, i.e., a series of mixing vanes, to promote mixing of the fuel and air. The air is obtained from an accumulator which stores compressed air from some source, such as a crankcase compressor, an external compressor, or a supercharger. The compressed air is always being delivered to the combustion chamber of the two-stroke engine, either to scavenge exhaust gases during the exhaust stroke or to deliver fuel and air during the intake stroke. The fuel is injected into the stream of compressed air prior to entry into the baffle. The fuel and air mixture, however, must be delivered to the combustion chamber for combustion by standard methods, i.e., either spark ignition or compression ignition. Thus, the disclosed engine of Rocklein merely establishes a means to deliver fuel and air to the combustion chamber and does not control combustion in any manner designed to resolve emission issues.

The present invention is directed to overcoming one or more of the problems as set forth above.

SUMMARY OF THE INVENTION

In one aspect of the present invention a method for delivering a mixture of fuel and gas to a combustion chamber of a compression ignition engine is disclosed. The method includes the steps of compressing a gas to a pressure sufficient to initiate combustion of a fuel, delivering a stream of the gas toward the combustion chamber, injecting a quantity of fuel into the stream of gas to create a near homogeneous fuel and gas mixture, and delivering the fuel and gas mixture to the combustion chamber such that combustion occurs substantially within the combustion chamber.

In another aspect of the present invention an apparatus for delivering a mixture of fuel and gas to a combustion chamber of a compression ignition engine is disclosed. The apparatus includes a compressor, an accumulator for storing a quantity of gas compressed by the compressor at a pressure sufficient to initiate combustion of a fuel, a passageway from the accumulator to the combustion chamber for delivering a quantity of compressed gas to the combustion chamber at a desired velocity, and a fuel injector located in the passageway for injecting a quantity of fuel into the quantity of compressed gas.

In yet another aspect of the present invention an apparatus for delivering a mixture of fuel and gas to a combustion chamber of a compression ignition engine is disclosed. The apparatus includes an intake valve providing an inlet for air to the combustion chamber, an exhaust valve providing an outlet for exhaust gas from the combustion chamber, an outlet port from the combustion chamber having a check valve located therein, an accumulator connected to the outlet port for receiving at least one of compressed air and exhaust gas from the combustion chamber, and a passageway from the accumulator to the combustion chamber for delivering a mixture of compressed gas and fuel to the combustion chamber.

In yet another aspect of the present invention an apparatus for delivering a mixture of fuel and gas to a combustion chamber of a compression ignition engine is disclosed. The apparatus includes a first combustion chamber for receiving a mixture of fuel and gas, combusting the mixture, and creating a resultant exhaust gas, a second combustion chamber, and a passageway located between the first and second combustion chambers for delivering a mixture of fuel and the exhaust gas to the second combustion chamber.

In still another aspect of the present invention an apparatus for delivering a mixture of fuel and gas to a combustion chamber of a compression ignition engine is disclosed. The apparatus includes a first cylinder having a piston movable therein and defining a compressor, an intake valve for providing an inlet for air to the compressor, an outlet port having a check valve located therein and for delivering compressed air from the compressor, an accumulator for receiving the compressed air at a pressure sufficient to initiate combustion of a fuel, a second cylinder having a piston movable therein and defining a combustion chamber, and a passageway for delivering a mixture of fuel and compressed air from the accumulator to the combustion chamber at a velocity sufficient for combustion to occur substantially within the combustion chamber.

In still another aspect of the present invention an apparatus for delivering a mixture of fuel and gas to a combustion chamber of a compression ignition engine is disclosed. The apparatus includes a first cylinder having a piston movable therein and defining a compressor, a first accumulator for receiving compressed uncooled gas from the compressor, a cooler for receiving a portion of the compressed uncooled gas and creating compressed cooled gas, a second accumulator for receiving the compressed cooled gas, a first valve actuator located in the first accumulator, a second valve actuator located in the second accumulator, and a second cylinder having a piston movable therein and defining a combustion chamber, and for receiving at least one of a quantity of compressed uncooled gas and a quantity of compressed cooled gas.

BRIEF DESCRIPTION OF THE DRAWINGS

FIG. 3*a* is a diagrammatic illustration of a passageway;

FIG. 3*b* is a diagrammatic illustration of an alternate version of the passageway;

FIG. 3*c* is a diagrammatic illustration of yet another version of the passageway;

FIG. 6*a* is a top view of the embodiment of FIG. 5;

FIG. 6*b* is a top view of another version of the FIG. 5 embodiment;

FIG. 6*c* is a top view of yet another version of the FIG. 5 embodiment;

DETAILED DESCRIPTION

Figure 1:
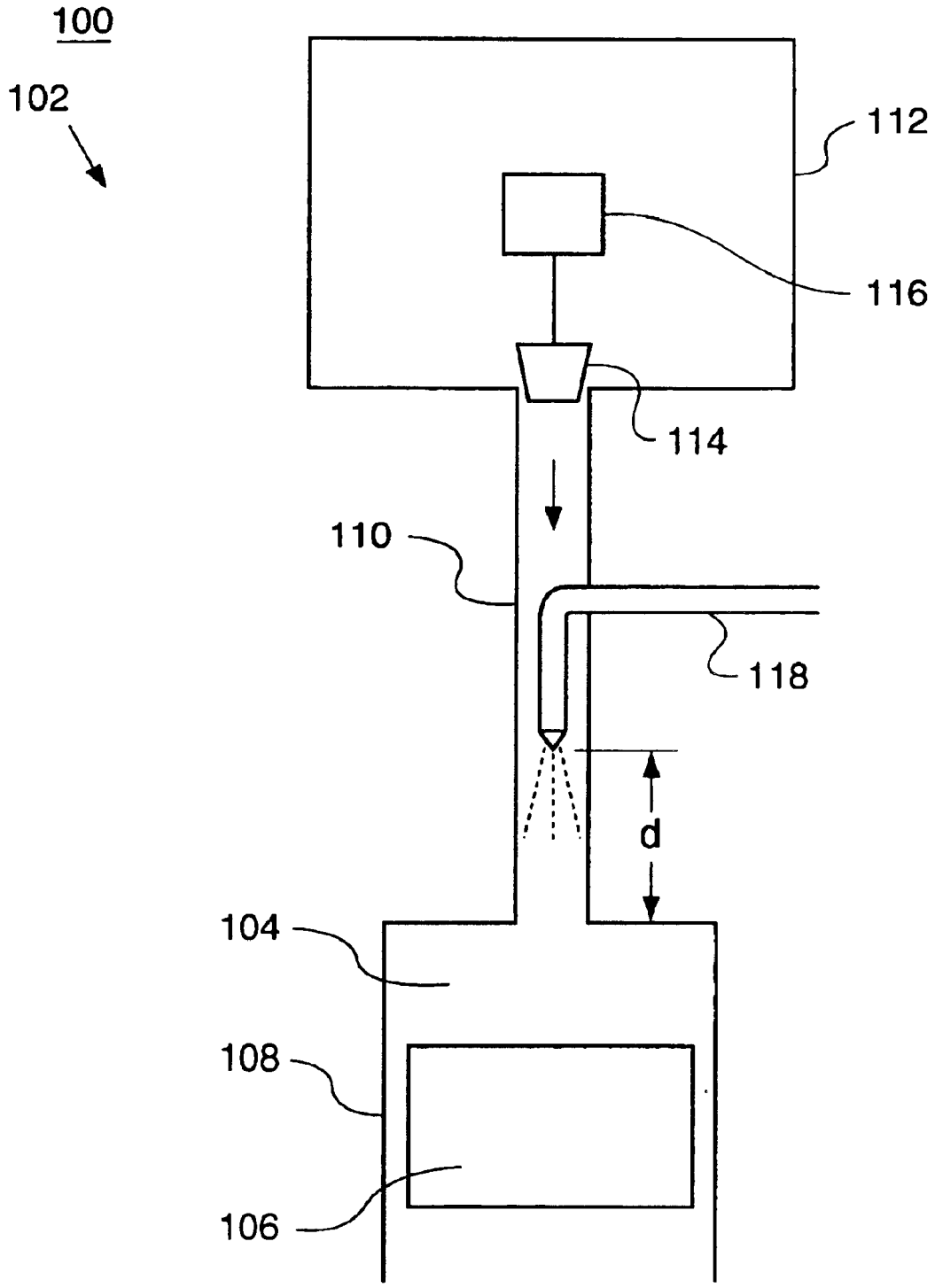
FIG. 1 is a diagrammatic illustration of a first embodiment of the present invention.

Referring to the drawings, a method and apparatus 100 for delivering a mixture of fuel and gas to a combustion chamber 104 of a compression ignition engine 102 is shown. The fuel may be any type suited for compression ignition engines, for example diesel fuel. The gas may be any type of fluid suited for performance as an oxidant, for example fresh air, recirculated exhaust gas, or a combination thereof.

Referring particularly to FIG. 1, a general embodiment of the present invention is depicted by way of a diagrammatic illustration. A piston 106 and a cylinder 108 define a combustion chamber 104, as is well known in the art of engine construction. An accumulator 112 is configured to receive compressed gas, for example by a means described below. Preferably, the pressure of the gas is sufficient to initiate combustion of the fuel when the gas and fuel are combined. A passageway 110 provides fluid communication between the accumulator 112 and the combustion chamber 104, for example from the accumulator 112 to the combustion chamber 104. Flow of the compressed gas may be controlled from the accumulator 112 by a valve 114 and actuator 116, for example a hydraulically actuated valve. Alternatively, the valve 114 may be controlled by an actuator 116 using other than hydraulic techniques, for example mechanical, electrical, and the like.

A fuel injector 118 located in the passageway 110 provides controlled injection of fuel into a stream of compressed gas flowing through the passageway 110 toward the combustion chamber 104. Preferably, the fuel injector 118 is located in the passageway 110 at a distance d from the combustion chamber 104. The distance d may be chosen such that combustion of the fuel and gas mixture occurs substantially within the combustion chamber 104. The distance d may be a function of a velocity v of the gas moving through the passageway 110 and an ignition delay characteristic i of the fuel. For example, d may be defined as $$d \leq v*i \qquad \text{(Eq. 1)}$$

It may be desired for combustion of the fuel and gas mixture to take place completely within the combustion chamber 104. However, it may also be desired for combustion to begin occurring as the fuel and gas mixture approaches the combustion chamber 104, for example, within a 5 to 10 percent portion of the passageway 110 adjacent the combustion chamber 104. It is noted that both mixing of the fuel and gas and the combustion process initiate as the fuel is injected into the compressed stream of gas. However, the distance d and the velocity v of the stream of gas are such that combustion of the fuel and gas mixture is delayed until the mixture is substantially within the combustion chamber 104.

Figure 2:
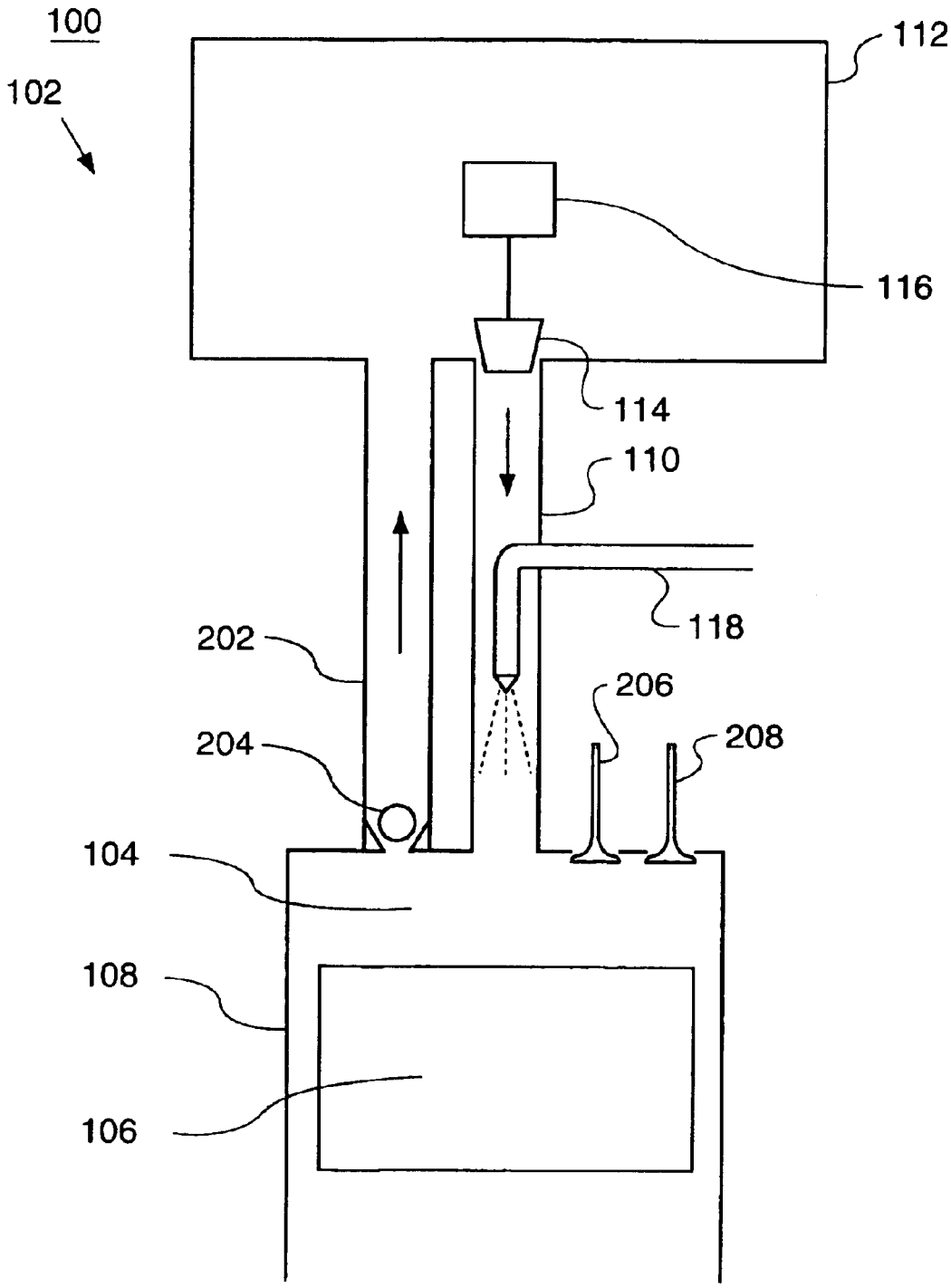
FIG. 2 is a diagrammatic illustration of another embodiment of the present invention.

Referring to FIG. 2, a diagrammatic illustration of an embodiment of the present invention is shown. An intake valve 206 and an exhaust valve 208 are depicted to provide a respective inlet for air and an outlet for exhaust gas to and from the combustion chamber 104. The intake and exhaust valves 206,208 may be of any type configuration and operation as is well known in the art.

An outlet port 202 from the combustion chamber 104 provides fluid communication with the accumulator 112. For example, exhaust gas may be controllably delivered from the combustion chamber 104 to the accumulator 112 under pressure sufficient to initiate combustion of the fuel. A check valve 204 may be used to provide further control of the delivery of compressed exhaust gas. As an example of operation, the exhaust valve 208 may open during a portion of an exhaust stroke of the engine 102, and may be closed prior to completion of the exhaust stroke. The remaining exhaust gas is compressed as the piston 106 continues to move toward top dead center until the pressure of the exhaust gas exceeds the force of the check valve 204. The check valve 204 then opens, allowing compressed exhaust gas to enter the accumulator 112 by way of the outlet port 202.

It is noted that, in the present embodiment as well as embodiments described below, any device functioning to compress gas may be defined as a compressor, although the principle function of that device may be for other purposes, such as combustion. For example, in the present embodiment, the combustion chamber 104, outlet port 202, check valve 204, and exhaust valve 208 may function together as a compressor during a portion of engine operation.

Referring to FIGS. 3*a*–3*c*, the passageway 110 is shown in more detail. FIG. 3*a* depicts the passageway 110 of FIGS. 1 and 2. More specifically, the passageway 110 may be a tube, e.g., cylindrical, having a constant diameter along the length.

In FIG. 3*b*, however, the passageway 110 has a converging portion 302 and a diverging portion 304, such as found in a converging/diverging nozzle.

The converging and diverging portions 302,304 provide control over the velocity of the compressed gas and may define a velocity profile for the gas along the length of the passageway 110. The velocity profile may help determine where combustion of the fuel and gas mixture begins. Furthermore, flow losses along the length of the passageway 110 may be minimized by design of the converging and diverging portions 302,304. It is noted that variations of the passageway 110 having a converging portion 302 and a diverging portion 304 may be used. For example, an additional converging portion (not shown) may be included downstream of the diverging portion 304.

FIG. 3*c* illustrates another variation of the passageway 110. A perforated inner wall 306 is surrounded by a solid outer wall 308. A portion of the compressed gas flows within the space between the inner and outer walls 306,308 and travels through the perforations along the length of the passageway 110, thus enhancing the mixing of the fuel with the compressed gas. In a variation of this embodiment, the pressure of the gas within the space between the inner and outer walls 306,308 may differ from the pressure of the gas flowing through the passageway 110. For example, the pressure of the gas flowing within the space between the inner and outer walls 306,308 may be greater than the pressure of the gas flowing through the passageway 110, thus preventing fuel from contacting the walls 306,308 of the passageway 110.

It is noted that the embodiments of the passageway 110 shown in FIGS. 3*a*–3*c* are exemplary only. Other embodiments may be used and various combinations of embodiments may be used without deviating from the spirit and scope of the present invention.

Figure 4A:
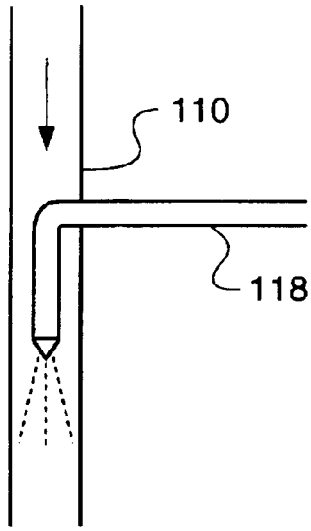
FIG. 4*a* is a diagrammatic illustration of the passageway having a fuel injector located therein.
Figure 4B:
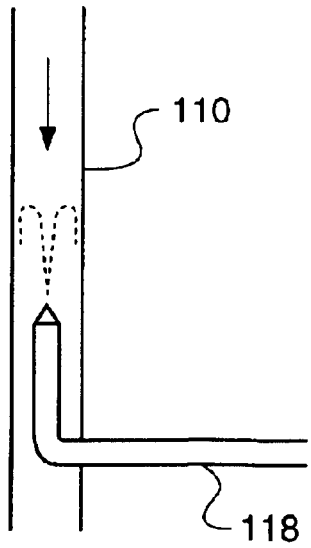
FIG. 4*b* is a diagrammatic illustration of another configuration of the passageway and fuel injector.

Referring to FIGS. 4*a* and 4*b*, alternate embodiments of the positioning of the fuel injector 118 within the passageway are shown. In FIG. 4*a*, the fuel injector 118 is positioned such that fuel is injected in a direction equal to the direction of flow of the compressed gas. In FIG. 4*b*, the fuel injector 118 is positioned such that fuel is injected in a direction opposite to the direction of flow of the compressed gas, thus providing more thorough mixing of the fuel with the gas.

Figure 5:
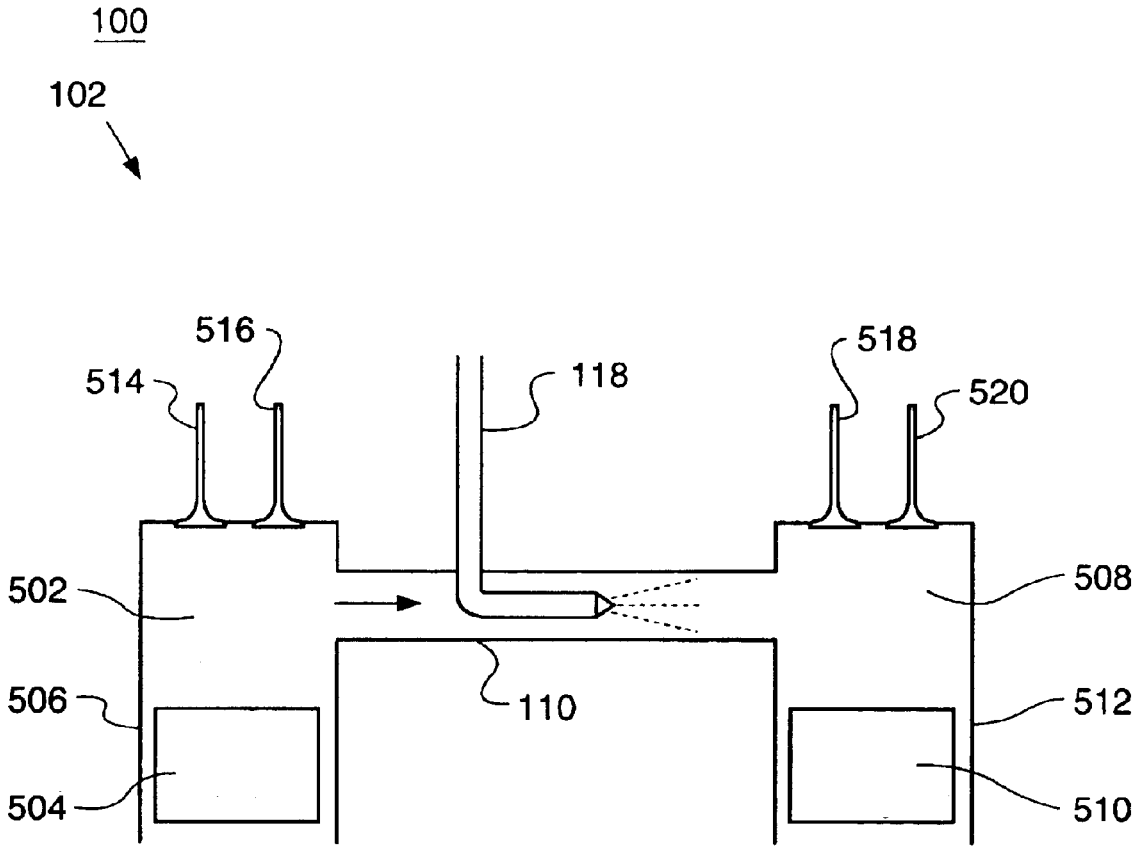
FIG. 5 is a diagrammatic illustration of another embodiment of the present invention.

Referring to FIG. 5, a diagrammatic illustration of another embodiment of the present invention is shown. A first piston 504 and a first cylinder 506 define a first combustion chamber 502. The first combustion chamber 502 may include a first intake valve 514 and a first exhaust valve 516. The first combustion chamber 502 may operate in a normal engine operating mode, receiving fuel and gas via the first intake valve 514, and possibly a fuel injector (not shown), and combusting the fuel and gas mixture.

A second piston 510 and a second cylinder 512 define a second combustion chamber 508. The second combustion chamber may include a second intake valve 518 and a second exhaust valve 520. Preferably, the second piston 510 moves in tandem with the first piston 504, i.e., the first and second pistons 504,510 reach top dead center at substantially the same time.

A passageway 110 provides fluid communication between the first and second combustion chambers 502,508. More particularly, as the first combustion chamber 502 combusts a fuel and gas mixture, the highly pressurized exhaust gas is in fluid communication from the first combustion chamber 502 to the second combustion chamber 508 by way of the passageway 110. As the compressed exhaust gas travels through the passageway 110, a fuel injector 118 may inject a quantity of fuel into the stream of gas such that the fuel and gas mixture travels to the second combustion chamber 508 and combusts substantially within the second combustion chamber 508.

Referring to FIGS. 6*a*–6*c*, top views of the first and second combustion chambers 502 508 depicting various configurations of the passageway 110 are shown. FIG. 6*a* illustrates an essentially linear passageway 110 from the first combustion chamber 502 to the second combustion chamber 508.

FIG. 6*b* shows two passageways 110 from the first to the second combustion chambers 502,508, such that the fuel and gas mixture enters the second combustion chamber 508 from opposite sides, thus causing the mixture to collide within the second combustion chamber 508 and promote more thorough mixing of the fuel and compressed exhaust gas. FIG. 6*c* is a variation of the configuration of FIG. 6*b*. It is noted that other configurations for delivering the fuel and compressed exhaust gas mixture may be used without deviating from the spirit and scope of the present invention.

Figure 7:
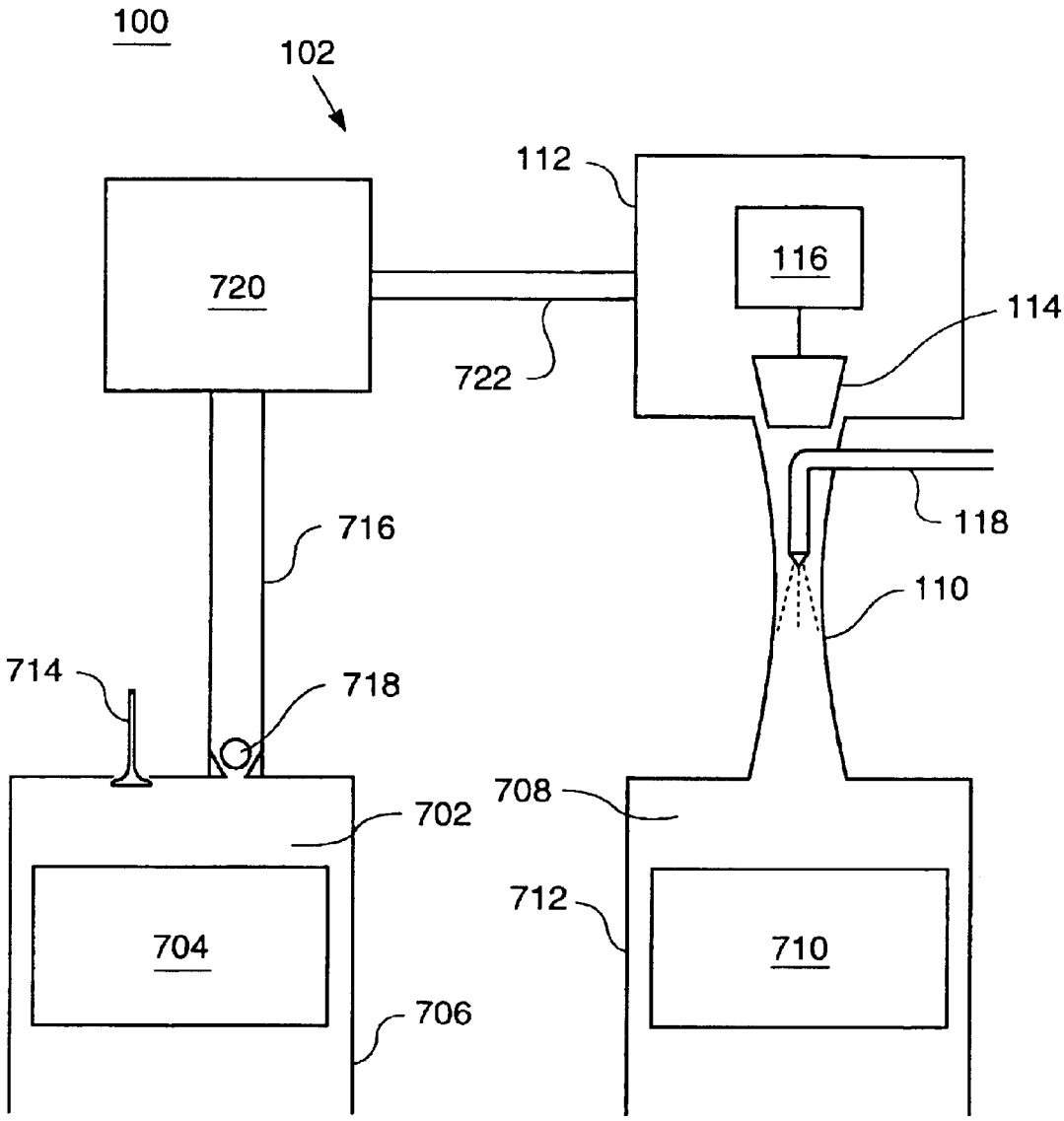
FIG. 7 is a diagrammatic illustration of yet another embodiment of the present invention.

Referring to FIG. 7, a diagrammatic illustration of yet another embodiment of the present invention is shown. A first piston 704 and a first cylinder 706 define a compressor 702. An intake valve 714 provides for intake of fresh air into the compressor 702. An outlet port 716 provides for delivery of compressed air from the compressor 702 through a check valve 718. Preferably, the air is compressed to a pressure sufficient to initiate combustion of the fuel.

The compressed air may be delivered to a cooler 720, for example an aftercooler. The cooled air may then be delivered from the cooler 720 to an accumulator 112 by way of a cooler output conduit 722. The cooler 720 may be omitted if desired. In this case, the compressed air may be delivered from the compressor 702 directly to the accumulator 112. Furthermore, it is noted that a cooler may be used in any of the previously described embodiments, for example in any of FIG. 1,2, or 5.

A second piston 710 and a second cylinder 712 define a combustion chamber 708. A passageway 110 provides fluid communication between the accumulator 112 and the combustion chamber 708, preferably from the accumulator 112 to the combustion chamber 708. A valve 114 and actuator 116 provide controlled flow of the compressed gas, as is described above. A fuel injector 118 controllably injects fuel into the passageway 110 such that fuel and gas are mixed and combust as the mixture substantially arrives at the combustion chamber 708.

Figure 11:
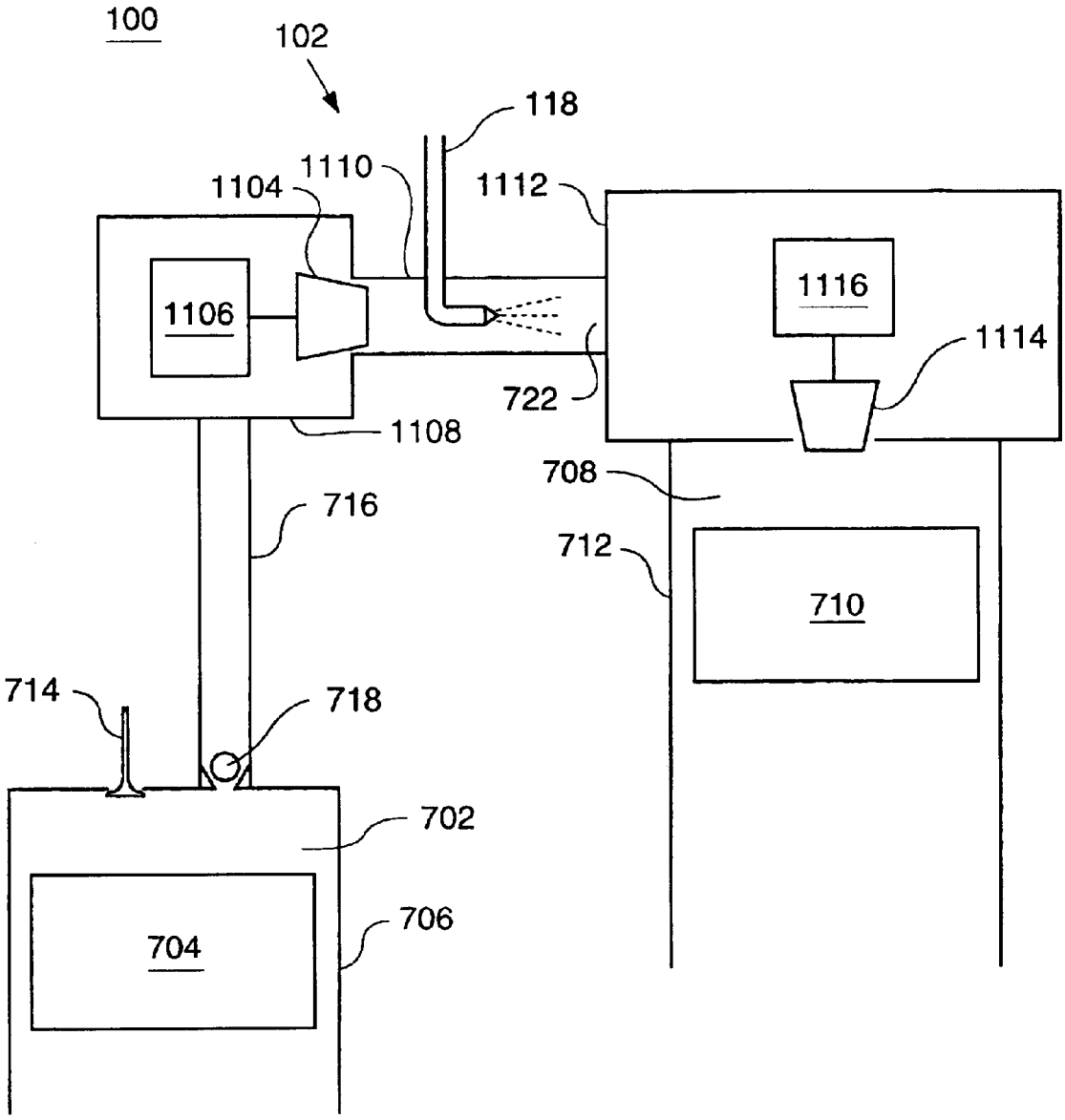
FIG. 11 is a diagrammatic illustration of yet another embodiment of the present invention.

Referring to FIG. 11, a diagrammatic illustration of yet another embodiment of the present invention is shown. The embodiment of FIG. 11 is similar to the embodiment of FIG. 7 in that a first piston 704 and a first cylinder 706 define a compressor 702, an intake valve 714 provides for intake of fresh air into the compressor 702, and an outlet port 716 provides for delivery of compressed air from the compressor 702 through a check valve 718. The compressed air, however, is delivered to an accumulator 1108. The accumulator 1108 may include a first valve 1104 and a first actuator 1106. The compressed air is controllably delivered to a passageway 1110, and fuel is injected into the stream of compressed air by way of fuel injector 118. The compressed fuel and air mixture is then delivered to a combustion prechamber 1112, where combustion occurs as a result of the initiation of combustion of the premixed fuel and air, as described above. The products of the combustion process in the combustion prechamber 1112, i.e., combusted gases, may then be controllably delivered to the combustion chamber 708 by way of a second valve 1114 and a second actuator 1116. The combustion products, being under pressure from the combustion process, may then perform work to move the piston 710 in a downward direction, in the same manner as though combustion took place within the combustion chamber 708. Variations of this embodiment, e.g., additional passageways, fuel injectors, and such, may be employed to perform work on the piston 710 to further reduce emissions, optimize performance, and the like. The embodiment of FIG. 11 may allow a continuous flow of fuel and compressed air through the passageway 1110, thus causing continuous combustion within the combustion prechamber 1112. This continuous combustion may reduce undesirable emission byproducts that are caused by combustion events which start and stop repeatedly.

Figure 8:
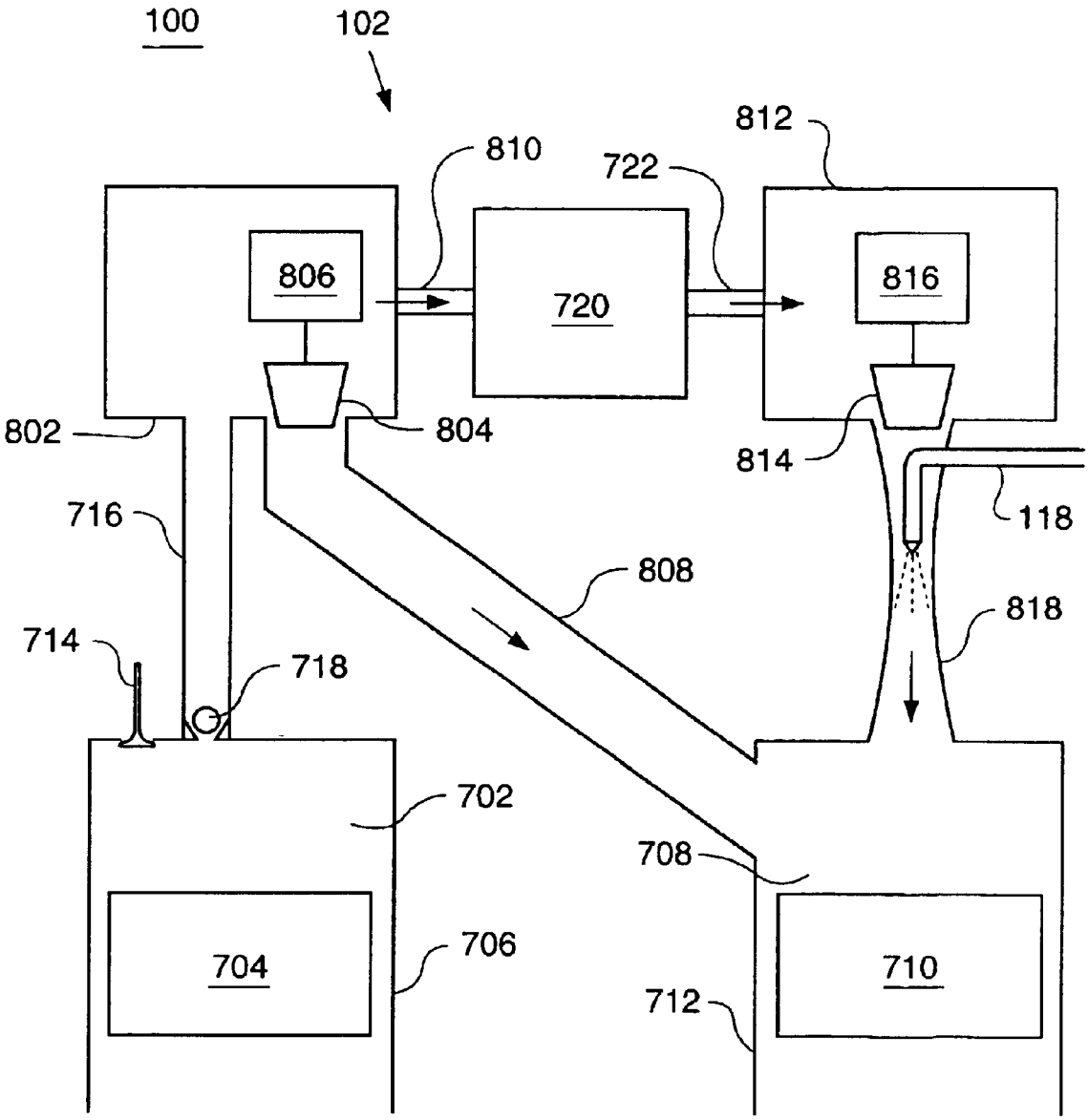
FIG. 8 is a diagrammatic illustration of still another embodiment of the present invention.

Referring to FIG. 8, a diagrammatic illustration of still another embodiment of the present invention is shown. A first piston 704 and a first cylinder 706 define a compressor 702. An intake valve 714 provides an intake for fresh air. An outlet port 716 provides an outlet for compressed air by way of a check valve 718. The compressed air is delivered to a first accumulator 802, in which a portion of the compressed air is stored as uncooled gas.

Another portion of the compressed air is delivered to a cooler 720, e.g., an aftercooler, by way of a cooler input conduit 810. The cooled compressed air is delivered from the cooler 720 to a second accumulator 812 by way of a cooler output conduit 722, in which that portion of the compressed air is stored as cooled gas.

A second piston 710 and a second cylinder 712 define a combustion chamber 708. A first passageway 808 provides fluid communication between the first accumulator 802 and the combustion chamber 708. Preferably, the first passageway 808 provides fluid communication for compressed uncooled gas from the first accumulator 802 to the combustion chamber 708. Delivery of the compressed uncooled gas may be controlled by a first valve 804 and a first actuator 806, for example a hydraulic valve actuator.

A second passageway 818 provides fluid communication between the second accumulator 812 and the combustion chamber 708. Preferably, the second passageway 818 provides fluid communication for the compressed cooled gas from the second accumulator 812 to the combustion chamber 708. Delivery of the compressed cooled gas may be controlled by a second valve 814 and a second actuator 816, for example a hydraulic valve actuator. A fuel injector 118, located in the second passageway 818, provides controlled injection of fuel into the stream of compressed cooled gas such that a fuel and gas mixture is created which is designed to combust when the fuel and gas mixture substantially arrives at the combustion chamber 708.

Under normal engine operating conditions, the combustion chamber 708 may receive a supply of mixed fuel and gas from the second accumulator 812 only. However, during periods of time when additional bursts of torque may be needed, the combustion chamber 708 may also receive a quantity of compressed uncooled gas from the first accumulator 802.

Figure 9:
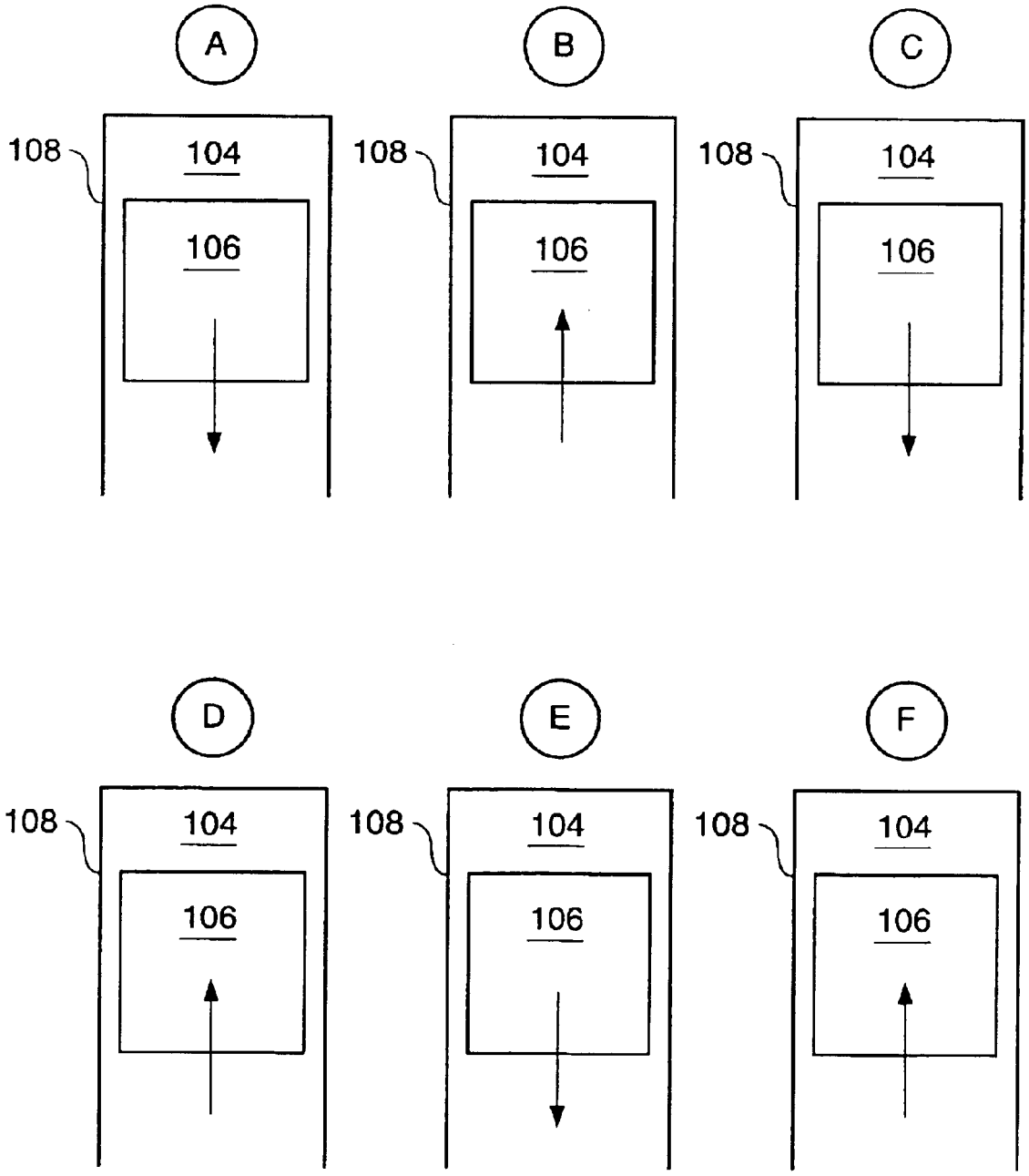
FIG. 9 is a diagrammatic representation of various exemplary strokes of an engine used with the present invention.

Referring to FIG. 9, a series of diagrammatic illustrations depicting various exemplary strokes of a piston 106 within a cylinder 108 of an engine 102 are shown. It is noted that the six strokes indicated are examples only, and that a series of operating strokes may vary from engine to engine, from cylinder to cylinder within an engine, or from one period of time to another within one cylinder depending upon operating conditions. The six strokes exemplified differ from standard four or two stroke operation. However, four or two stroke operation of an engine may be used as well with the present invention, dependent upon the embodiment used.

During a first stroke A, fresh air is drawn into the combustion chamber 104 as the piston 106 moves toward bottom dead center. For purposes of ease of explanation, operation of intake and exhaust valves, and other intake or output ports are not shown nor described, although it is understood that such operation is necessary for proper operation.

During a second stroke B, the fresh air is compressed as the piston 106 moves toward top dead center. In addition, the compressed fresh air is delivered to an accumulator (not shown).

During a third stroke C, the piston 106 moves toward bottom dead center and a mixture of compressed air, i.e., compressed gas, and fuel is drawn into the combustion chamber 104. The pressure of the compressed gas may be sufficient to initiate combustion of the fuel. However, due to the high velocity of the gas and fuel mixture and an ignition delay characteristic of the fuel, combustion may not occur until the gas and fuel mixture has substantially arrived at the combustion chamber 104. This combustion further aids the movement of the piston 106 toward bottom dead center.

During a fourth stroke D, the piston 106 moves toward top dead center and exhaust gas from combustion is removed by way of an exhaust valve (not shown). Furthermore, a portion of the exhaust gas may be compressed by the upward movement of the piston 106 and delivered to the accumulator (not shown) to combine with compressed fresh air previously delivered. For example, the exhaust valve (not shown) may be actuated to close earlier than normal, thus trapping a portion of exhaust gas within the combustion chamber 104. The increasing pressure of the remaining exhaust gas may overcome the force of a check valve (not shown), thus providing a passage to the accumulator. In an alternative embodiment, the exhaust valve may be actuated to close later than normal. This action may serve to draw back a portion of the exhaust gas into the combustion chamber 104 during a subsequent expansion stroke, e.g., a fifth stroke E or a first stroke A. The exhaust gas returning to the combustion chamber 104 creates an internal exhaust gas recirculation (EGR) effect.

A fifth stroke E and a sixth stroke F are repeats of the respective third and fourth strokes C and D. Operation then repeats at the first stroke A. However, variations of the above described strokes may be employed. For example, during periods of heavy load operation, the third and fourth strokes C and D, and consequently the fifth and sixth strokes E and F, may be repeated an additional time before returning to the first stroke A, thus creating eight strokes of operation. Alternatively, during light load operation, the fifth and sixth strokes E and F may be deleted, thus leaving strokes A, B, C, and D as the operating strokes.

Typically, an engine 102 will have multiple cylinders 108. Depending upon the embodiment of the present invention used, all cylinders may function alike, or some cylinders may function differently. For example, in the embodiments represented by FIGS. 7 and 8, some cylinders may function as compressors, and the remaining cylinders may function as combustion chambers. It may be desired to design some cylinders having different dimensions, e.g., diameters, than other cylinders. For example, cylinders designed to function as compressors may have different diameters, e.g., larger, than cylinders designed to function as combustion chambers.

INDUSTRIAL APPLICABILITY

Figure 10:
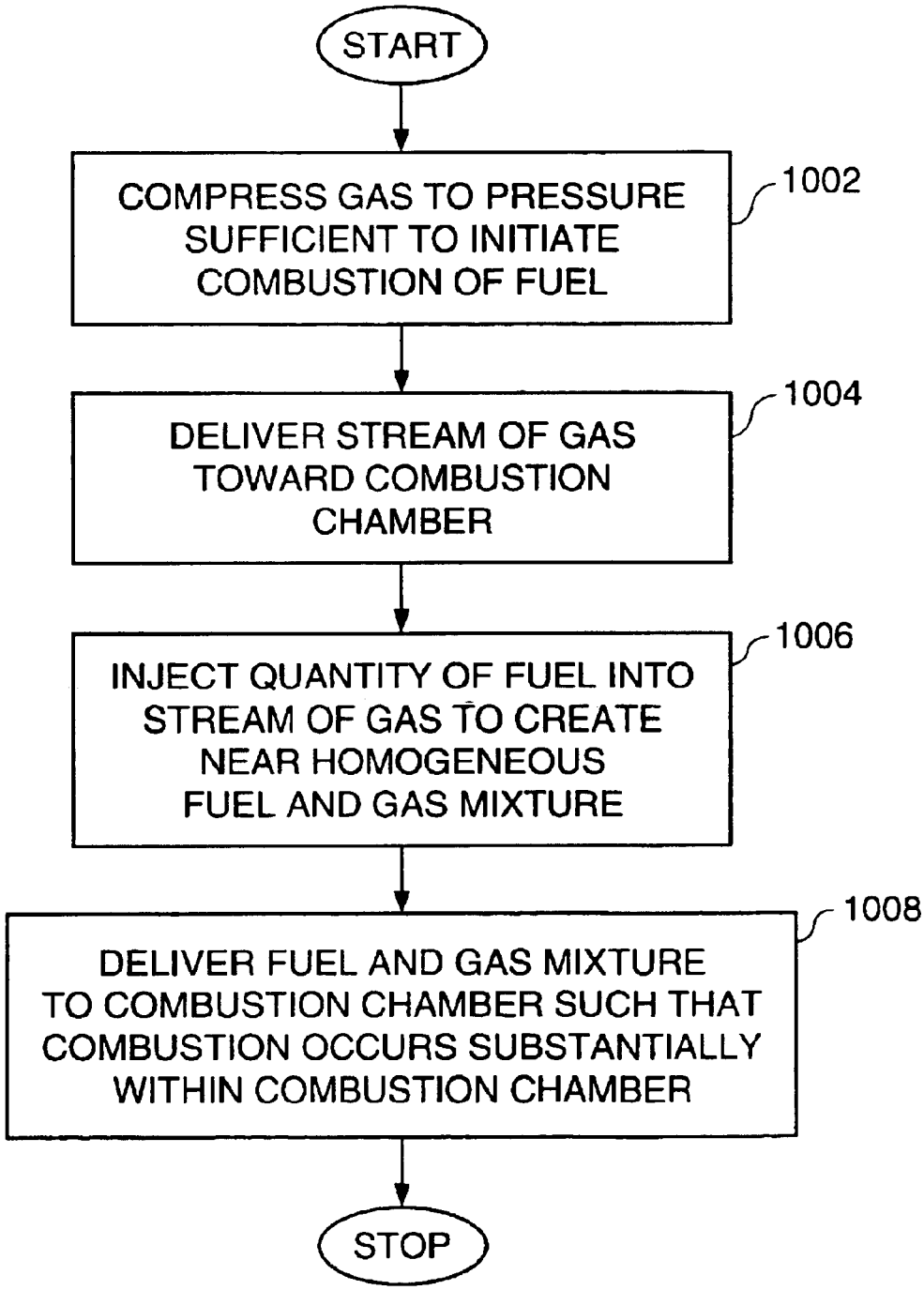
FIG. 10 is a flow diagram illustrating a preferred method of the present invention.

A preferred method of operation of the present invention may be illustrated with reference to the flow diagram of FIG. 10.

In a first control block 1002, a gas such as fresh air, recirculated exhaust gas, or a combination thereof, is compressed to a pressure sufficient to initiate combustion of a fuel. The compressed gas may be delivered and stored in an accumulator 112 for use as needed.

In a second control block 1004, a quantity of the compressed gas is delivered as a stream toward a combustion chamber 104 by way of a passageway 110.

In a third control block 1006, a quantity of fuel is injected into the stream of gas in the passageway 110 such that the fuel and compressed gas combine to create a near homogeneous mixture.

In a fourth control block 1008, the fuel and gas mixture is delivered to the combustion chamber 104 such that combustion occurs substantially within the combustion chamber 104. Preferably, the velocity at which the gas and fuel mixture travel through the passageway 110, the length of the passageway 110, and an ignition delay characteristic of the fuel are factored together to delay combustion until the gas and fuel mixture is at the desired location.

Other aspects can be obtained from a study of the drawings, the disclosure, and the appended claims.

What is claimed is:

1. A method for delivering a mixture of fuel and gas to a combustion chamber of a compression ignition engine, comprising the steps of:

compressing a gas to a pressure sufficient to initiate combustion of a fuel;

delivering a stream of the gas toward the combustion chamber;

injecting a quantity of fuel into the stream of gas to create a near homogeneous fuel and gas mixture; and delivering the fuel and gas mixture to the combustion chamber such that combustion occurs substantially within the combustion chamber.

2. A method, as set forth in claim 1, wherein delivering the fuel and gas mixture to the combustion chamber includes the step of delivering the fuel and gas mixture to the combustion chamber at a velocity sufficient for combustion to occur substantially within the combustion chamber.

3. A method, as set forth in claim 1, wherein injecting a quantity of fuel into the stream of gas includes the step of injecting a quantity of fuel into the stream of gas in the same direction as the flow of the stream of gas.

4. A method, as set forth in claim 1, wherein injecting a quantity of fuel into the stream of gas includes the step of injecting a quantity of fuel into the stream of gas in a direction opposite to the flow of the stream of gas.

5. A method, as set forth in claim 1, wherein compressing a gas includes the steps of:

compressing at least one of a quantity of fresh air and exhaust gas; and delivering the compressed gas to an accumulator.

6. A method, as set forth in claim 5, further including the step of cooling the compressed gas.

7. A method, as set forth in claim 5, wherein delivering a stream of the gas toward the combustion chamber includes the step of delivering a quantity of the compressed gas from the accumulator toward the combustion chamber.

8. A method, as set forth in claim 7, wherein delivering a quantity of the compressed gas from the accumulator toward the combustion chamber includes the step of controllably delivering a quantity of the compressed gas toward the combustion chamber at a desired velocity profile.

9. A method, as set forth in claim 1, wherein compressing a gas includes the steps of:

combusting a fuel and gas mixture in a first combustion chamber;

producing a responsive exhaust gas from the combustion of the fuel and gas mixture;

delivering the exhaust gas from the first combustion chamber to a second combustion chamber; and injecting a quantity of fuel into the exhaust gas to create a near homogeneous fuel and gas mixture prior to delivery to the second combustion chamber.

10. A method, as set forth in claim 1, wherein compressing a gas includes the steps of:

compressing a quantity of fresh air by at least one piston and associated cylinder; and delivering the compressed air to an accumulator.

11. An apparatus for delivering a mixture of fuel and gas to a combustion chamber of a compression ignition engine, comprising:

a compressor;

an accumulator for storing a quantity of gas compressed by the compressor at a pressure sufficient to initiate combustion of a fuel;

a passageway from the accumulator to the combustion chamber for delivering a quantity of compressed gas to the combustion chamber at a desired velocity; and a fuel injector located in the passageway for injecting a quantity of fuel into the quantity of compressed gas.

12. An apparatus, as set forth in claim 11, wherein the desired velocity is sufficient such that combustion of the fuel and compressed gas occurs substantially within the combustion chamber.

13. An apparatus, as set forth in claim 12, wherein the desired velocity is a function of a length of the passageway from the fuel injector to the combustion chamber and of an ignition delay characteristic of the fuel.

14. An apparatus, as set forth in claim 11, wherein the quantity of gas includes at least one of a quantity of air and a quantity of exhaust gas.

15. An apparatus, as set forth in claim 12, wherein the passageway is configured to deliver the compressed gas at a desired velocity profile.

16. An apparatus, as set forth in claim 11, wherein the compressor includes a piston and associated cylinder for receiving a quantity of air, compressing the air, and delivering the compressed air to the accumulator.

17. An apparatus, as set forth in claim 11, wherein the compressor includes the combustion chamber and a check valve located between the combustion chamber and the accumulator for providing a path for compressed exhaust gases to deliver to the accumulator.

18. An apparatus, as set forth in claim 11, further including an actuator located between the accumulator and the passageway for controllably delivering compressed gas from the accumulator to the passageway.

19. An apparatus, as set forth in claim 18, wherein the actuator is a hydraulic valve actuator.

20. An apparatus, as set forth in claim 11, wherein the fuel injector is located in the passageway such that fuel is injected in a direction equal to the direction of flow of the compressed gas.

21. An apparatus for delivering a mixture of fuel and gas to a combustion chamber of a compression ignition engine, comprising:

an intake valve providing an inlet for air to the combustion chamber;

an exhaust valve providing an outlet for exhaust gas from the combustion chamber;

an outlet port from the combustion chamber having a check valve located therein;

an accumulator connected to the outlet port for receiving at least one of compressed air and exhaust gas from the combustion chamber; and a passageway from the accumulator to the combustion chamber for delivering a mixture of compressed gas and fuel to the combustion chamber.

22. An apparatus, as set forth in claim 21, further including a valve actuator located between the accumulator and the passageway.

23. An apparatus, as set forth in claim 21, further including a fuel injector located in the passageway.

* * * * *